US007438823B2

(12) United States Patent
Nien et al.

(10) Patent No.: US 7,438,823 B2
(45) Date of Patent: Oct. 21, 2008

(54) IMPRINT METHOD FOR MANUFACTURING MICRO CAPACITIVE ULTRASONIC TRANSDUCER

(75) Inventors: Chin-Chung Nien, Hsinchu (TW); Hong Chen Ho, Hsinchu (TW); Ming-Wei Chang, TaiPing (TW)

(73) Assignee: Industrial Technology Research Institute, Hsinchu (TW)

( * ) Notice: Subject to any disclaimer, the term of this patent is extended or adjusted under 35 U.S.C. 154(b) by 53 days.

(21) Appl. No.: 10/732,265

(22) Filed: Dec. 11, 2003

(65) Prior Publication Data

US 2005/0127033 A1 Jun. 16, 2005

(51) Int. Cl.
*B44C 1/22* (2006.01)

(52) U.S. Cl. ..... 216/52; 29/594; 29/595

(58) Field of Classification Search ..... None
See application file for complete search history.

(56) References Cited

U.S. PATENT DOCUMENTS 6,768,246 B2 * 7/2004 Pelrine et al. ..... 310/339
2005/0205422 A1 * 9/2005 Moser et al. ..... 204/403.06

* cited by examiner

*Primary Examiner*—Allan Olsen
(74) *Attorney, Agent, or Firm*—Troxell Law Office, PLLC

(57) ABSTRACT

The present invention relates to an imprint method for manufacturing micro capacitive ultrasonic transducer, which uses a mold with a particularly patterned surface to imprint into a flexible material thus forming the oscillation cavities of the ultrasonic transducer. Such imprint method not only realizes the volume manufacturing and reduces the cost, but also can precisely control the geometrical size of the oscillation cavities and thus shorten the distance between the upper and the lower electrodes to the micro/nano level, largely improving the sensitivity of the transducer. Moreover, the present invention further changes the procedure for manufacturing micro capacitive ultrasonic transducer of the prior art, which can both save the process steps and overcome the disadvantages in the prior art.

20 Claims, 8 Drawing Sheets

IMPRINT METHOD FOR MANUFACTURING MICRO CAPACITIVE ULTRASONIC TRANSDUCER

FIELD OF THE INVENTION

The present invention relates to a method for manufacturing ultrasonic transducer, in particular to a method for manufacturing micro capacitive ultrasonic transducer. In detail, the present invention employs the nanoimprint lithography method to manufacture the micro capacitive ultrasonic transducer.

BACKGROUND OF THE INVENTION

The technology of ultrasonic inspection has been developed since the World War II. In the beginning, it is used for the national defense and the military affairs. Until 1950s, the ultrasonic inspection technology started to be widely employed on the medical treatments. In the area of the ultrasonic inspection, ultrasonic transducer plays a very important role thus attracting the industry/government/academia to plunge into the research in the past decades, and the related technologies are also getting more and more mature now. Among all the ultrasonic transducers, the piezoelectric transducer was kept the main stream for a long time.

The so-called piezoelectric effect includes both of the direct piezoelectric effect and the converse piezoelectric effect. Under the direct piezoelectric effect, a piezoelectric body, when put into an electric field, will be elongated along the direction of the electric field according to the elongating of the electrical dipole moment thus transferring the mechanical energy into electric energy. On the contrary, under the converse piezoelectric effect, if the piezoelectric body was pressed, the electrical dipole moment thereof will be shortened. In order to resist this tendency, the piezoelectric body thus will induce voltage for trying to keep the original state. With such character, the piezoelectric transducer transfers the electrical signals into the sonic signals, and also can transfer the sonic signals into the electrical signals thus being able to regard as a probe in the ultrasonic inspection. The common material of the piezoelectric body can be the ceramic, such as BaTiO3 and PZT, and the single crystal materials, such as quartz, tourmaline, tantalates, and columbate. However, the piezoelectric transducer still exit some disadvantages, for example the cost of such piezoelectric transducer is too high, and the oscillation of the crystal lattice will easily debase the bandwidth and the sound pressure. Moreover, the difference between the impedances of the piezoelectric material and that of the air is so large as to cause the unmatched phenomenon thus resulting in large reflection of the sonic signals in the contact interface and diminish the inspection efficiency. In addition, for the limitation of the resolution and the bandwidth, the piezoelectric transducer is hardly to be used for the precise inspection in nano-level.

Instead of the piezoelectric transducer, the micro capacitive ultrasonic transducer has become the main stream of the ultrasonic transducer research. The related patents have also been gradually accumulated recently, such as U.S. Pat. Nos. 6,426,582, 6,004,832, and 6,295,247 and so on. Please refer to FIG. 1, which shows the basic structure of the micro capacitive ultrasonic transducer. A plurality of the support pedestals 12 is formed on the substrate 11, and the oscillation film 13 with an upper electrode 14 thereon is formed on the support pedestal 12. Wherein, the substrate 14 doped with impurities to get conductivity is used to be the lower electrode for forming a capacitance structure with the upper electrode 14. The oscillation cavity 15 composed of the substrate 11, the support pedestal 12, and the oscillation film 13 is used to provide the space for oscillation when the oscillation film 13 is vertically oscillating. Such micro capacitive ultrasonic transducer possesses the following merits: (1) larger bandwidth; (2) easily to form large density array; (3) simply to be integrated with the front-end circuits on the same wafer; and (4) being able to largely manufacture thus reducing the cost.

In fact, the important character of the micro capacitive ultrasonic transducer is the design of the oscillation cavity and the oscillation film, so the geometric parameters of the oscillation cavity and the oscillation film, such as the radius and the thickness of the oscillation film and the distance between the upper electrode and the lower electrode, are rigidly related to the efficiency of the ultrasonic transducer. Therefore, it is very important to control all of such geometric parameters more stably and more uniformly in the manufacturing process. Please refer to FIG. 2A to 2C, which are the schematic views showing the traditional method for manufacturing the micro capacitance ultrasonic transducer of the prior art. Firstly, a substrate 21 is provided, and then a support film 22, an oscillation film 23 and a conductive layer 24 are successively formed on the substrate 21. A plurality of holes 25 that penetrates the oscillation film 23 and the conductive layer 24 then is 1o generated after the procedure of photolithography and etching. Finally, through the plurality of holes 25, the support film 22 can be etched to form a plurality of oscillation cavities 221 thereon. Because of the character that the selectivity of the etching rate on the support film 22 and the oscillation film 23 is different, the etching solution that preferentially etches the support film 22 rather than the oscillation film 23 is used to form a plurality of oscillation cavities 221 thus completing the whole ultrasonic transducers. Wherein, the shape of the oscillation cavities 221 is approximate cylinder that expanded from the center of the holes 25. However, such method is hardly to control the precise shape of the oscillation cavities and cannot provide the check mechanism. It only depends on the experience so that many vibrations in the process, such as the variation of the etching solution concentration, will very easily cause the variation of the geometrical size of the oscillation cavities 221 further affecting the character of the whole transducers.

Moreover, the plurality of holes 25 used for the entries of the etching solution and the exits of the etching by-products will easily cause the contamination of the oscillation cavities 221, remaining certain residues on the wall of the cavities thus affecting the characters of the transducer. The present invention thus provides a new method not only for overcoming the aforesaid disadvantages but also for improving the character of the ultrasonic transducers.

SUMMARY OF THE INVENTION

The primary object of the present invention is to provide an imprint method for manufacturing micro capacitive ultrasonic transducer. The method employs a particularly patterned mold to form the oscillation cavities of micro capacitance ultrasonic transducer thus obtaining the purposes of large batch manufacturing, uniform control, and cost reduction.

The secondary object of the present invention is to precisely control the size of the oscillation cavities of micro capacitive ultrasonic transducer, reducing the distance between the top and the bottom electrodes thus increasing the sensitivity of the ultrasonic transducer.

The third object of the present invention is to provide an imprint method for manufacturing micro capacitive ultrasonic transducer, which can improve the cleanness of the oscillation cavities without generating entry holes in the prior art that provide the entries of the etching liquid and the exits of the byproducts.

In order to achieve the aforesaid objects, the present invention provides an imprint method for manufacturing ultrasonic transducer, including the following steps:

a) Providing a substrate with electric conductance.
b) Forming a support film layer on the substrate.
c) Providing a mold with a patterned surface, wherein the patterned surface having an array pattern with projections and recesses arranged in order.
d) Imprinting the mold into the support film layer with the patterned surface thus transferring the array pattern into the support film layer.
e) Removing the mold, a plurality of recessions corresponding to the array pattern thus formed within the support film layer.
f) Providing a polymer film, the polymer film having an obverse side and a reverse side
g) Forming a plurality of upper electrodes corresponding to the recessions and a plurality of conductor lines between any two adjoining upper electrodes on the polymer film.
h) Sticking the reverse side of the polymer film onto the support film layer to seal the recessions and become a plurality of cavities thus completing a plurality of ultrasonic transducers.

In order to achieve the aforesaid objects, the present invention also provides another method including the following steps:

a) Providing a substrate with electric conductance.
b) Forming a support film layer on the substrate.
c) Providing a cylindrical mold with a patterned outer surface, the patterned outer surface having an array pattern with projections and recesses arranged in order.
d) Rotating the cylindrical mold over the support film layer thus transferring the array pattern into the support film layer, forming a plurality of recessions.
e) Providing a polymer film, the polymer film having an obverse side and a reverse side
f) Forming a plurality of upper electrodes corresponding to the recessions on the polymer film and a plurality of conductor lines between any two adjoining upper electrodes.
g) Sticking the reverse side of the polymer film onto the support film layer to seal the recessions and become a plurality of cavities thus completing a plurality of ultrasonic transducers.

DETAILED DESCRIPTION OF THE INVENTION

Figure 1:
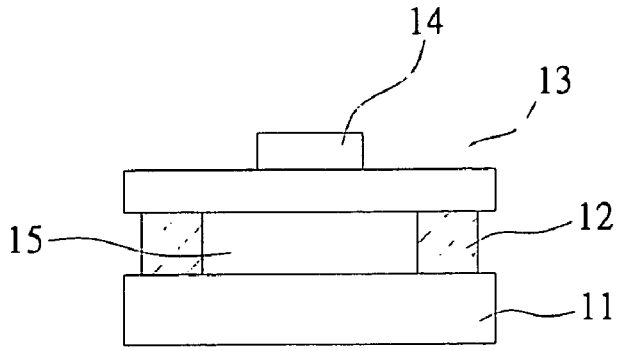
FIG.1(Prior art)
FIG. 1 is the schematic view showing the basic structure of the micro capacitive ultrasonic transducer.
Figure 2A:
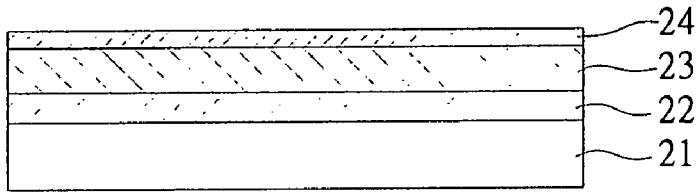
FIG.2A(Prior art)
FIG. 2A to FIG. 2C are the schematic views showing the method for manufacturing the micro capacitive ultrasonic transducer in the prior arts.
Figure 2B:
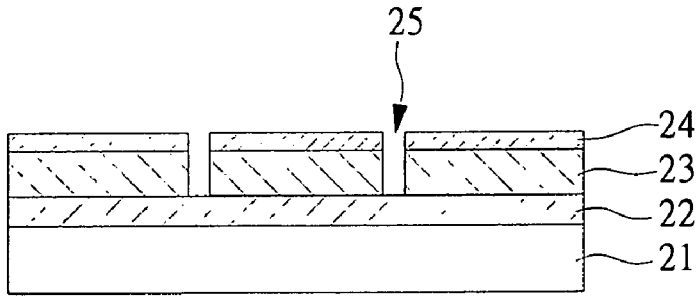
FIG.2B(Prior art)
Figure 2C:
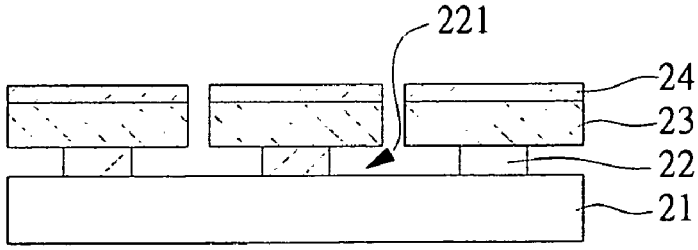
FIG.2C(Prior art)
Figure 3A:
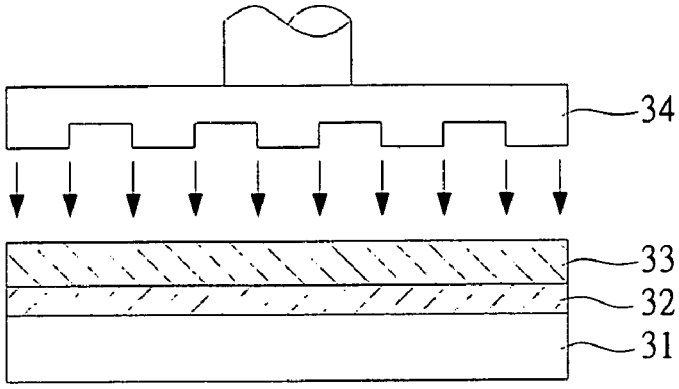
FIG.3A(Prior art)
FIG. 3A to FIG. 3E are the schematic views showing the nanoimprint lithography method applied in the semiconductor process.
Figure 3B:
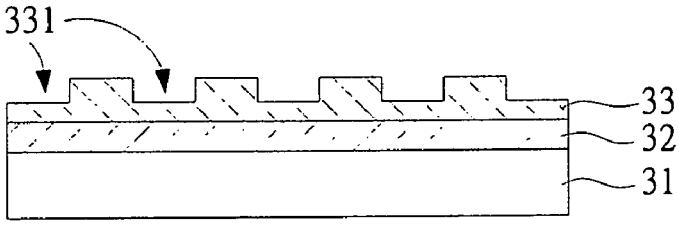
FIG.3B(Prior art)
Figure 3C:
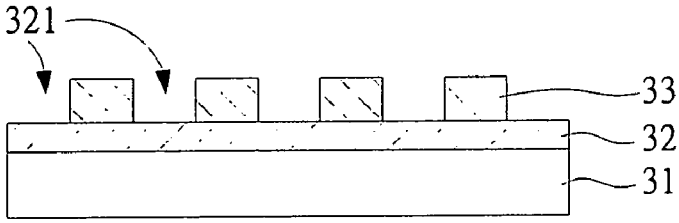
FIG.3C(Prior art)
Figure 3D:
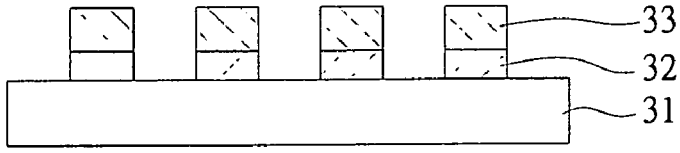
FIG.3D(Prior art)
Figure 3E:
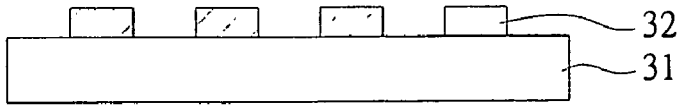
FIG.3E(Prior art)

Matched with corresponding drawings, the preferable embodiments of the invention are presented as following and hope they will benefit your esteemed reviewing committee members in reviewing this patent application favorably.

Nanoimprint lithography has developed since 1996 when Dr. Stephen Y. Chou published the related papers. Nanoimprint lithography is quiet different from the traditional lithography in semiconductor process; it does not need to use any energy beams, so the resolution in nanoimprint lithography will not be limited by the phenomenon of diffraction, scattering, and interference when optical wave entering into the photoresist and by the effect of back scattering from the substrate. In fact, the imprint method was disclosed at least as early as in 1970s, and the related researches as well as lots of the related patents have been accumulated, such as U.S. Pat. Nos. 4,035,226, 5,259,926, 5,772,905, and 6,375,870.

Please refer to FIG. 3A to FIG. 3E, which are the schematic views showing the technology of nanoimprint lithography applied in the semiconductor manufacturing process. Firstly, an isolation film 32 and a flexible film 33 keeping the state of plasticity are successively formed on a substrate 31. Then a mold 34 with relative projection and recess patterns formed on the surface thereof is pressed into the flexible film 33 thus transferring the pattern into the flexible film 33. In the process of imprinting, the projection portion of the patterned surface will not directly touch to the isolation film 32 thus forming a relative thin region 331 above the isolation film 32 and generating a relative high-low pattern corresponding to the pattern on the mold surface. Then, the relative thin region 331 is removed by the method of etching to reveal a partial isolation region 321 under the thin region 331. Finally, the partial isolation region 321 and the flexible film 33 are removed, and then the remaining portion of the isolation film 32 corresponding to the mold surface pattern can be used as the mask for the follow-up steps in semiconductor process such as ion implantation.

Obviously, the nanoimprint lithography employed in the semiconductor manufacturing process can save quiet a number of process steps. Moreover, the using of the mold not only accelerates the manufacture procedure, but also saves the high cost of the mask fabricating and maintaining. Besides, the array pattern is so practicable in mold manufacturing that nanoimprint lithography technology can be easily applied to the ultrasonic transducer manufacturing, providing the quiet innovation of the industry. The advantages of the nanoimprint lithography technology are:

1) Volume manufacturing.
2) Lower cost.
3) Variety choices of the polymer materials used for the oscillation film and the oscillation cavity, such as Biocompatible material, which makes the micro capacitive ultrasonic transducer more beneficial to apply in the biomedical science.
4) Shorting the height of the oscillation cavity and well controlling the uniformity thus improving the sensitivity of the ultrasonic transducer.
5) Employing the polymer material, instead of the silicon, in the oscillation cavity thus diminishing the effect of Lamb wave.
6) Unifying the materials of the oscillation film and the oscillation cavity, which are different in the conventional process and cause the different expansion coefficient, to overcome the problem of the stability of the transducer.

7) Precisely controlling the size of the ultrasonic transducer in micro or even nano level thus improving the efficiency of the transducer and enlarging the application thereof.

FIG. 4A to FIG. 4G are the schematic views showing the first embodiment of the present invention. As shown in the figures, the substrate 41 doped with impurity for electric conductivity is provided for the lower electrode of the ultrasonic transducer. In the preferable embodiment, a plurality of lower electrode plates can be formed on the substrate 41; wherein between any two of the adjoining lower electrode plates are linked by a conductor line. Then, a support film layer 42 is formed on the substrate 41. To operate in the nanoimprint technology, the material of the support film layer 42 has to be flexible polymer such as PMMA. In order to improve the sensitivity of the ultrasonic transducer, the support film layer 42 used to be the wall of the oscillation cavities of the transducer is better to be controlled as thin as possible. Further, a mold 51 with a patterned surface 511 is provided, and wherein the patterned surface 511 has an array pattern 512 with projections and recesses arranged in order. by using a driving apparatus, the mold 51 can be imprinted into the support film layer 42 with the patterned surface 511 thus transferring the array pattern 512 to the support film layer 42. After removing the mold 51, a plurality of recessions 421 corresponding to the array pattern 512 thus is formed on the support film layer 42. In the process of imprinting, the projection portion of the patterned surface will not directly touch to the surface of substrate 41; in other words, the bottom of the recessions 421 formed by the mold 51 will not touch to the substrate 41 thus a relatively thin region of the support film layer remains above the substrate 41. Next, the relatively thin region is removed by using the method of etching to reveal the substrate 41 on the recession bottom. Such method can prevent the mold from damaging the surface thereof and the substrate surface. Besides, the imprint method can be hot stamping, laser imprint, nanoimprint, and any other technologies that can generate the imprint-like effect.

Next, a polymer film 43 is provided on a platform, and a plurality of particularly arranged upper electrode plates 441 is formed on the polymer film 43. The upper electrode plate 441 is used as the upper electrode of the capacitive ultrasonic transducer, and between any two of the adjoining upper electrode plates is connected with a conductor line. Finally, the polymer film 43 with the upper electrode plates 441 thereon is stuck on the support film layer 42 thus sealing the recessions 421 becoming a plurality of closed cavities 422. Wherein the materials of the polymer film 43 and the support film layer 42 can be the same, which can prevent the problem of different expansion coefficient resulting in the instability of the ultrasonic transducer. On the closed cavities 422 is the polymer film 43, and on the polymer film 43 is the plurality of upper electrode plates 441; wherein the upper electrode plates are respectively corresponding to the closed cavities 422.

Figure 4A:
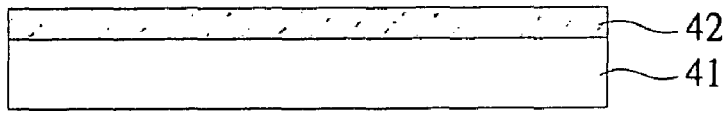
FIG. 4A to FIG. 4G are the schematic views showing the first embodiment of the present invention.
Figure 4B:
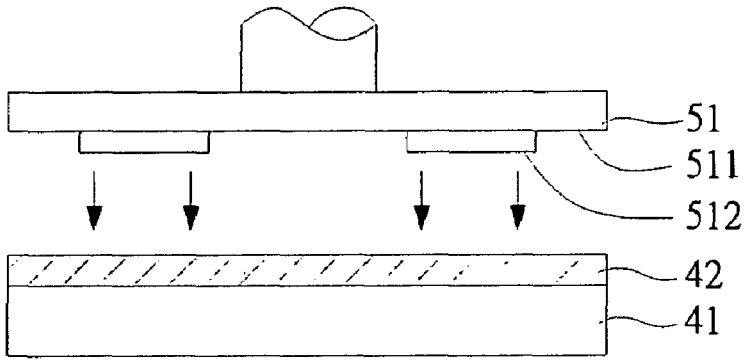
Figure 4C:
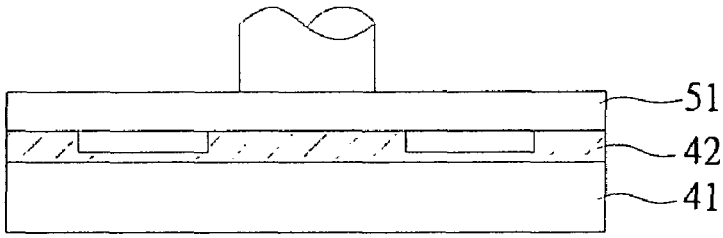
Figure 4D:
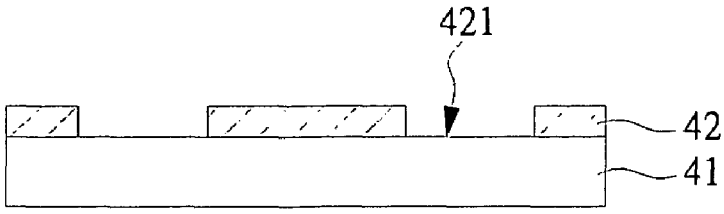
Figure 4E:
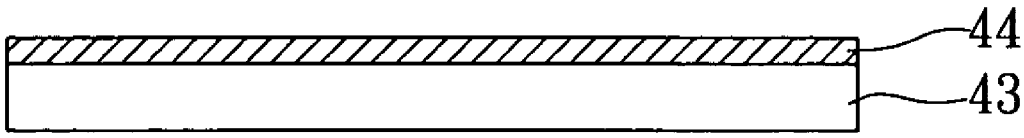
Figure 4F:
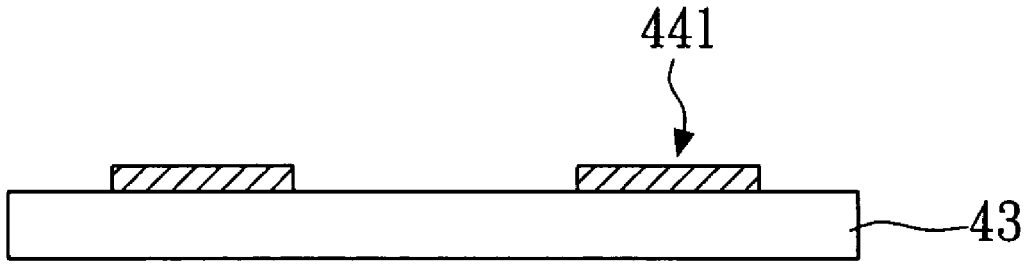
Figure 4G:
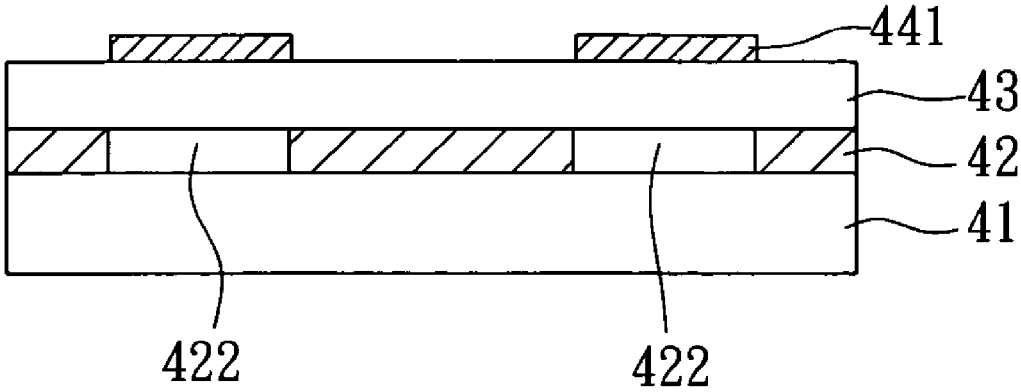
Figure 4H:
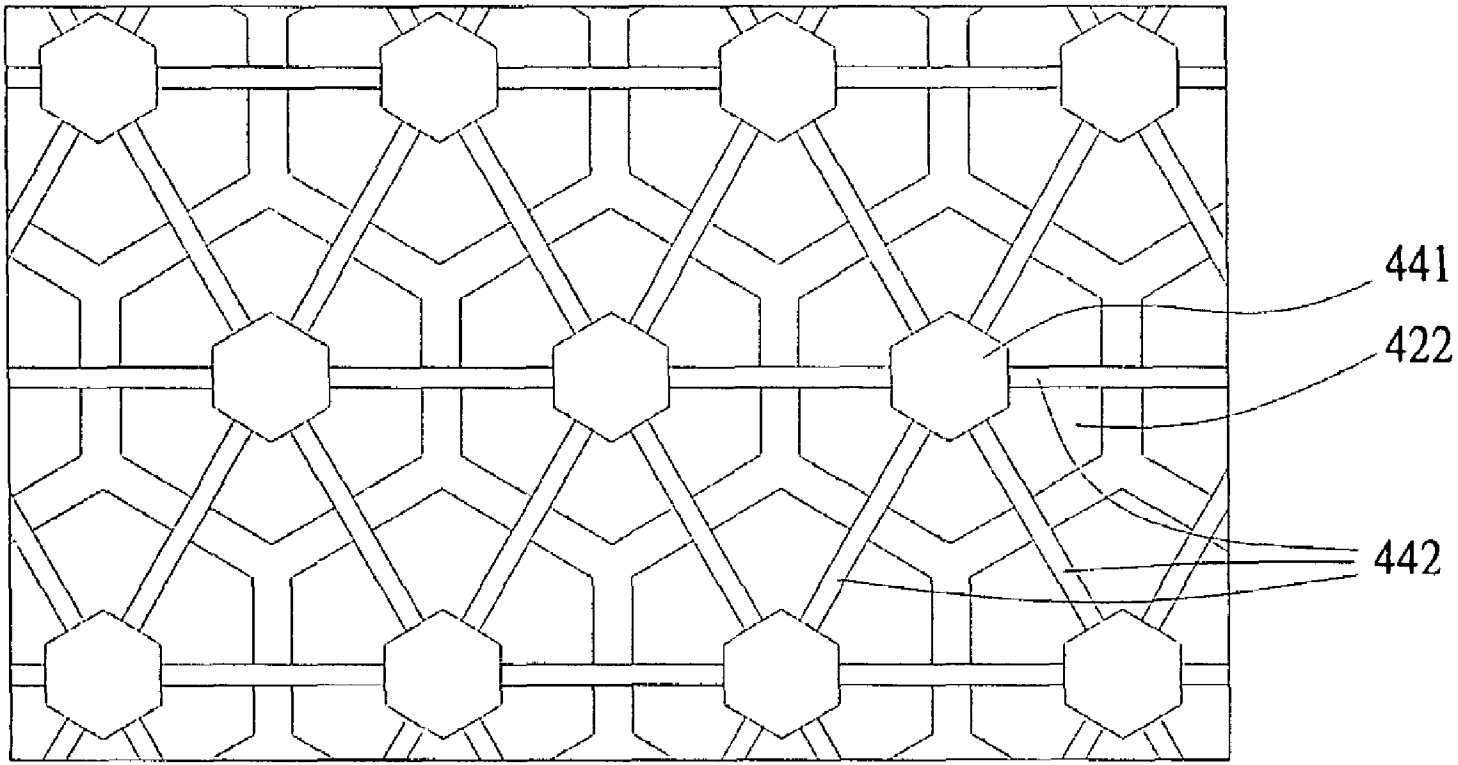
FIG. 4H is the top view of the micro capacitive ultrasonic transducer of the present invention.
Figure 5A:
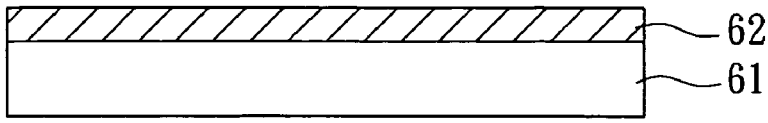
FIG. 5A to FIG. 5G are the schematic views showing the second embodiment of the present invention.
Figure 5B:
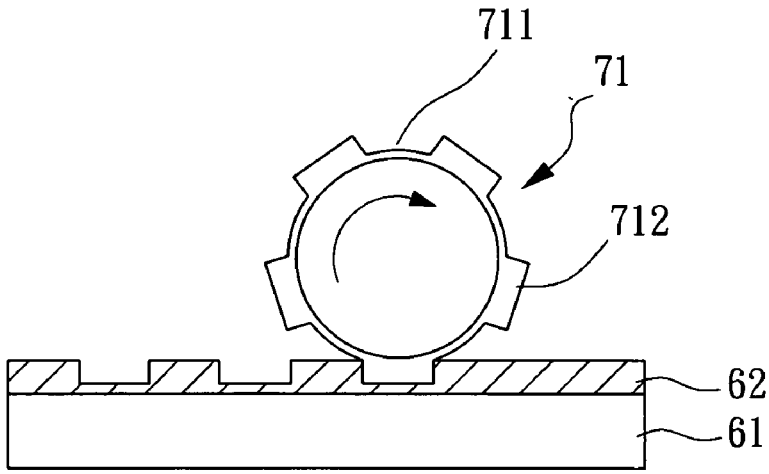
Figure 5C:
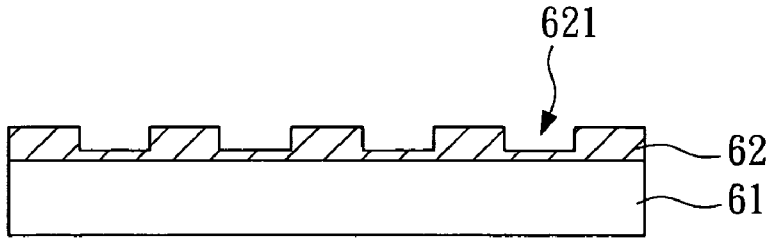
Figure 5D:
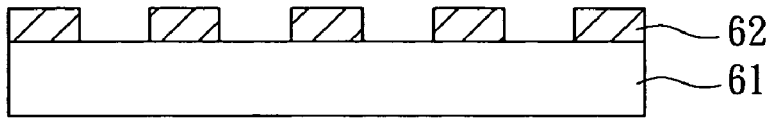
Figure 5E:
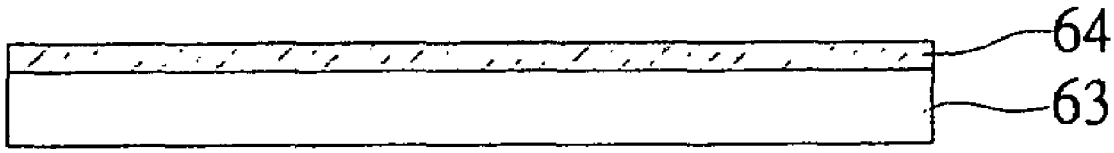
Figure 5F:
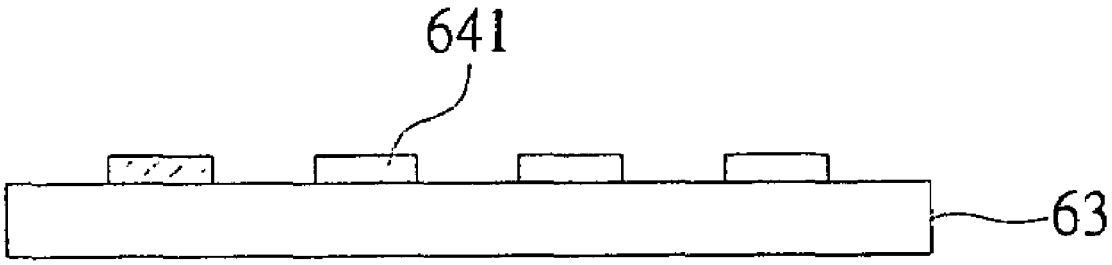
Figure 5G:
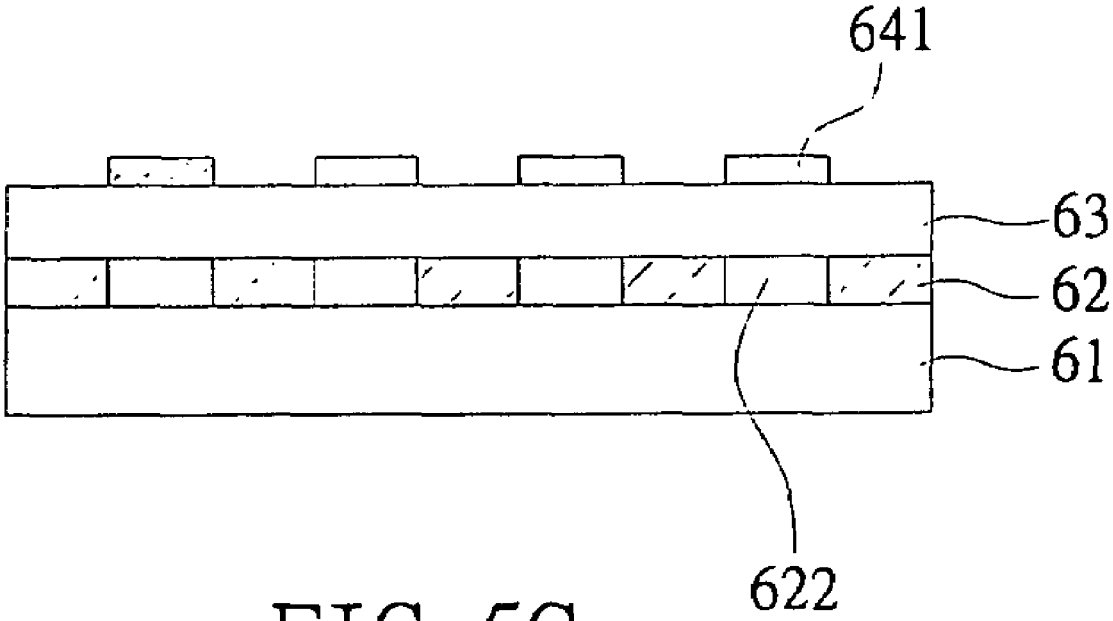
Figure 5H:
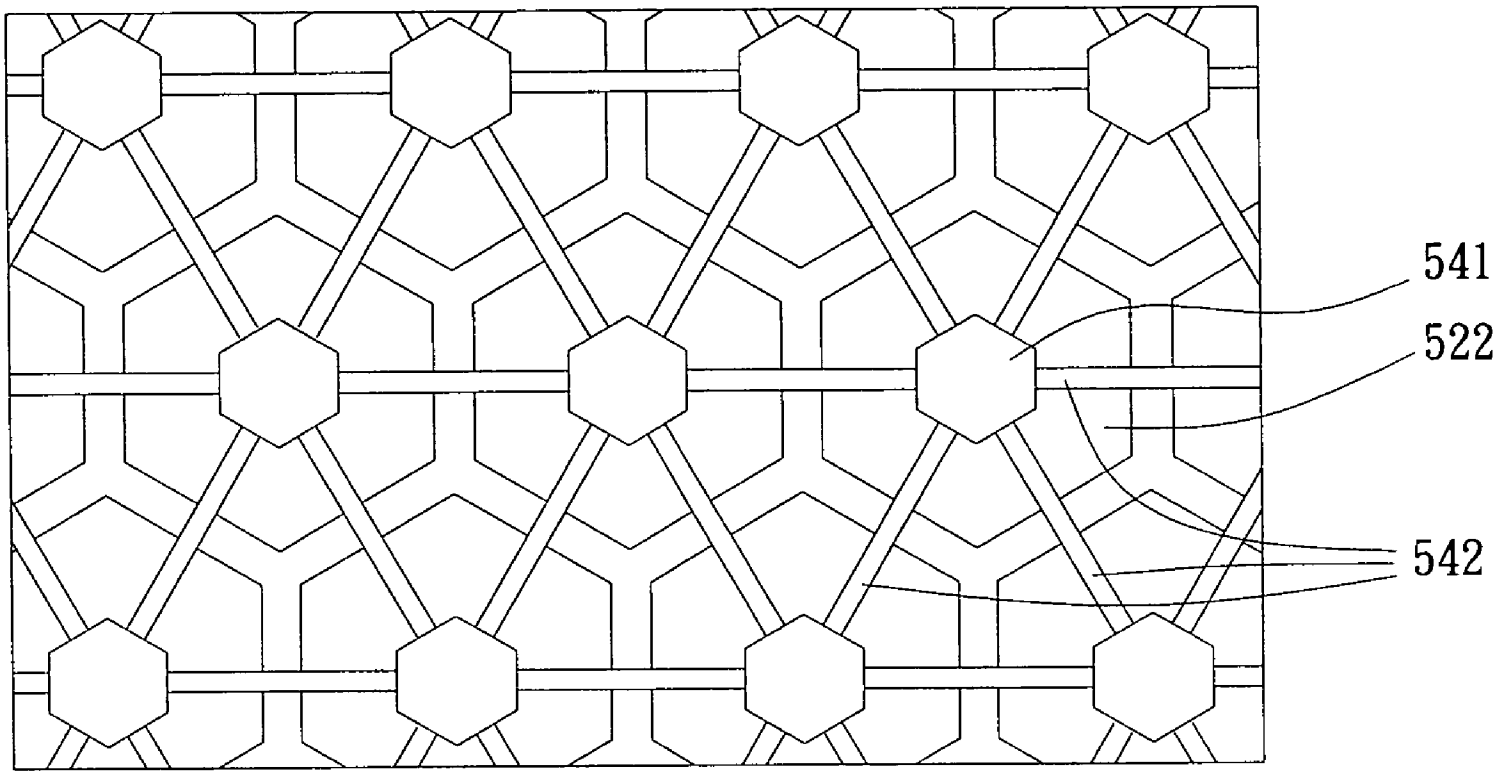
FIG. 5H is the top view of the micro capacitive ultrasonic transducer of the present invention.

Please refer to FIG. 4H, which is the top view showing the micro capacitive ultrasonic transducer of the present invention. The upper electrode plates 441 are respectively located onto the central area of the corresponding closed cavities 422, an the cross section area of the upper electrode plate 441 is about 60%~70% of that of the closed cavity 422; besides, between any two of the adjoining electrode plates 441 are linked by a conductor line 442. Taking off the substrate 41, a figure (not shown) from the bottom view will be obtained, corresponding to the elements shown in FIG. 4H, wherein the upper electrode plates will correspond to the lower electrode plates with the closed cavity 422 formed in between, and between any two of the adjoining lower electrode plates are also linked by a conductor line.

Moreover, the formation of the aforesaid upper electrode plates 441 can be the traditional semiconductor manufacturing process, including the following steps:

1) Forming a conductive layer 44 on a polymer film 43, then coating a photoresist film on the conductive layer 44.
2) Using photolithography technology to form a photoresist mask arranged in order on the photoresist film.
3) Etching the conductive layer 44 to form the upper electrode plates 441 corresponding to the photoresist mask.

Such method is employed when the material of conductive layer 44 is solid film, such as metal film or polycide. But if the material of conductive layer 44 is a flexible material, the nanoimprint technology can also be employed in the formation of the upper electrode plates 441, including the following steps:

1') Forming a conductive layer 44 onto the polymer film 43.
2') Proving a second mold with a patterned surface, wherein the patterned surface having a second array pattern with projections and recesses arranged in order.
3') Imprinting the second mold into the conductive film 44 thus transferring the second array pattern to the surface of the conductive film 44.
4') Removing the second mold, a plurality of the upper electrode plates 441 thus being formed on the polymer film 43.

Please refer to FIG. 5A to FIG. 5H, which are the schematic views showing the second preferable embodiment of the present invention. First, the substrate 61 doped with impurity for electric conductivity is provided for the lower electrode of the ultrasonic transducer. In the preferable embodiment, a plurality of lower electrode plates 541 can be formed on the substrate 61, and between any two of the adjoining lower electrode plates 541 are linked by a conductor line 542, and can include a plurality of closed cavities 522. Then a support film layer 62 is formed on the substrate 61. To operate in the nanoimprint technology, the material of the support film layer 62 has to be a flexible polymer, such as PMMS. Then, a cylindrical mold 71 with an array pattern 712 formed on the outer surface thereof is provided to press to and roll across the support film layer 62 thus forming a plurality of the particularly arranged recessions 621 on the support film layer 62. Similarly, in the rolling process of the cylindrical mold 71, the projection portion of the mold outer surface will not touch to the surface of the substrate 61. In other words, the bottom of the recessions 621 formed by the mold 71 will not touch to the substrate 61 thus a relatively thin region of the support film layer remains above the substrate 61. Next, removing the relatively thin region by the etching method to reveal the portion of the substrate 61.

Next, a polymer film 63 is provided on a platform, and a plurality of particularly arranged upper electrode plates 641 is formed on the polymer film 63. The upper electrode plate 641 is used as the upper electrode of the capacitance ultrasonic transducer, and between any two of the adjoining upper electrode plates is connected with a conductor line. Finally, the polymer film 63 with the upper electrode plates 641 thereon is stuck on the support film layer 62 thus sealing the recessions 621 becoming a plurality of closed cavities 622. Wherein, on the closed cavities 622 is the polymer film 63, and on the polymer film 63 is the plurality of upper electrode plates 641 corresponding to the closed cavities 622. The upper electrode plates 641 are respectively located onto the central area of the corresponding closed cavities 622, and the cross section area of the upper electrode plate 641 is about 60%~70% of that of the closed cavity 622; besides, between any two of the adjoining electrode plates is connected with a conductor line.

In addition, as described in the first embodiment of the present invention, the formation of the upper electrode plates 641 can be the tradition semiconductor manufacturing process if the material of the conductive film is solid film, such as metal film or polycide. However, if the material of the conductive film is also the flexible material, the imprint method thus can be employed, such as hot stamping, laser imprint, nanoimprint, the imprint methods described in the aforesaid two embodiments, and any other technologies that can generate the imprint-like effect.

Moreover, the formation of the upper electrode plates both in the first and the second embodiment can be carried out after the polymer film stuck onto the support film layer. In other words, after forming a plurality of recessions of the support film layer on the substrate, the polymer film can be struck onto the support film layer in advance thus sealing the plurality of recessions to become a plurality of the closed cavities for micro capacitive ultrasonic transducer. Finally, a plurality of the upper electrode plates corresponding to the closed cavities is formed on the polymer film thus completing a plurality of the micro capacitive ultrasonic transducers.

Although the present invention has been described with reference to a preferred embodiment, it should be appreciated that various modifications and adaptations can be made without departing from the scope of the invention as defined in the claims.

In summary, from the structural characteristics and detailed disclosure of each embodiment according to the invention, it sufficiently shows that the invention has progressiveness of deep implementation in both objective and function, also has the application value in industry, and it is an application never seen ever in current market and, according to the spirit of patent law, the invention is completely fulfilled the essential requirement of new typed patent.

What is claimed is:

1. An imprint method for manufacturing micro capacitive transducer, and the method includes:

a) providing a substrate with electric conductance;

b) forming a support film layer on the substrate;

c) forming a plurality of recessions within the support film layer by using an imprint method;

d) providing a polymer film, the polymer film having an obverse side and a reverse side;

e) forming a plurality of upper electrodes arranged in array on the polymer film and a plurality of conductor lines between any two of the adjoining upper electrodes; and f) sticking the reverse side of the polymer film onto the support film layer in order to seal the recessions to become a plurality of cavities with corresponding electrodes and thus completing a plurality of ultrasonic transducers.

2. The imprint method for manufacturing micro capacitive ultrasonic transducer recited in claim 1, wherein after the step a) is further a step a1):

a1) forming a plurality of lower electrode plates and a plurality of conductor lines between any two of the adjoining lower electrode plates onto the substrate.

3. The imprint method for manufacturing micro capacitive ultrasonic transducer recited in claim 1, wherein the formation of the recessions within the support film layer in the step c) includes the following steps:

(i) providing a mold with a patterned surface, wherein the patterned surface having an array pattern with projections and recesses arranged in order;

(ii) imprinting the mold into the support film layer with the patterned surface thus transferring the array pattern into the support film layer, and in the process of imprinting, the projection portion of the patterned surface being not able to touch to the surface of the substrate thus a relatively thin region of the support film remains above the substrate;

(iii) removing the mold, then a plurality of recessions corresponding to the array pattern thus formed within the support film layer; and (iv) etching and removing the relatively thin region to reveal the substrate on the bottom of the recessions.

4. The imprint method for manufacturing micro capacitive ultrasonic transducer recited in claim 1, wherein the formation of the recessions within the support film layer in the step c) includes the following steps:

(i') providing a cylindrical mold with a patterned outer surface, the patterned outer surface having an array pattern with projections and recesses arranged in order;

(ii') rotating the cylindrical mold over the support film layer thus transferring the array pattern into the support film layer, forming a plurality of recessions, wherein in the process of imprinting, the projection portion of the patterned surface will not touch to the surface of the substrate thus a relatively thin region of the support film layer remains above the substrate; and (iii') etching and removing the relatively thin region to reveal the substrate on the bottom of the recessions.

5. The imprint method for manufacturing micro capacitive ultrasonic transducer recited in claim 1, wherein the imprint method in the step c) can be chosen from the set of hot stamping, laser imprint, and nanoimprint.

6. The imprint method for manufacturing micro capacitive ultrasonic transducer recited in claim 1, wherein the formation of the plurality of upper electrodes in the step e) includes the following steps:

(1) forming a conductive layer on a polymer film, then coating a photoresist film on the conductive layer;

(2) using photolithography technology to form a photoresist mask arranged in order on the photoresist film; and (3) etching the conductive layer to form the plurality of upper electrode plates corresponding to the photoresist mask.

7. The imprint method for manufacturing micro capacitive ultrasonic transducer recited in claim 1, wherein the formation of the plurality of upper electrodes in the step e) includes the following steps:

(1') forming a conductive layer consisted of flexible material onto the polymer film; and (2') using an imprint method to form the plurality of upper electrodes within the conductive layer.

8. The imprint method for manufacturing micro capacitive ultrasonic transducer recited in claim 1, wherein the imprint method in the step (2') can be chosen from the set of hot stamping, laser imprinting, and nanoimprint.

9. The imprint method for manufacturing micro capacitive ultrasonic transducer recited in claim 1, wherein the material of the support film layer is a flexible polymer material.

10. The imprint method for manufacturing micro capacitive ultrasonic transducer recited in claim 1, wherein the material of the polymer film is the same as that of the support film layer, which is a flexible polymer material.

11. An imprint method for manufacturing micro capacitive ultrasonic transducer, and the method includes:

a) providing a substrate with electric conductance;

b) forming a support film layer on the substrate;

c) forming a plurality of recessions within the support film layer by using an imprint method;

d) sticking a polymer film onto the support film layer thus the plurality of the recessions becoming a plurality of closed cavities, and the polymer film forming the upper face of the closed cavities; and e) forming a plurality of upper electrodes arranged in array on the polymer film and a plurality of conductor lines between any two of the adjoining upper electrodes.

12. The imprint method for manufacturing micro capacitive ultrasonic transducer recited in claim 11, wherein after the step a) is further a step a1):

a1) forming a plurality of lower electrode plates and a plurality of conductor lines between any two of the adjoining lower electrode plates onto the substrate.

13. The imprint method for manufacturing micro capacitive ultrasonic transducer recited in claim 11, wherein the formation of the recessions within the support film layer in the step c) includes the following steps:

(i) providing a mold with a patterned surface, wherein the patterned surface having an array pattern with projections and recesses arranged in order;

(ii) imprinting the mold into the support film layer with the patterned surface thus transferring the array pattern into the support film layer, wherein in the process of imprinting, the projection portion of the patterned surface will not touch to the surface of the substrate thus a relatively thin region of the support film layer remains above the substrate;

(iii) removing the mold, then a plurality of recessions corresponding to the array pattern thus formed within the support film layer; and (iv) etching and removing the relatively thin region to reveal the substrate on the bottom of the recessions.

14. The imprint method for manufacturing micro capacitive ultrasonic transducer recited in claim 11, wherein the formation of the recessions within the support film layer in the step c) includes the following steps:

(i') providing a cylindrical mold with a patterned outer surface, the patterned outer surface having an array pattern with projections and recesses arranged in order;

(ii') rotating the cylindrical mold over the support film layer thus transferring the array pattern into the support film layer, forming a plurality of recessions, wherein in the process of imprinting, the projection portion of the patterned surface will not touch to the surface of the substrate thus a relatively thin region of the support film layer remains above the substrate; and (iii') etching and removing the relative relatively thin region to reveal the substrate on the bottom of the recessions.

15. The imprint method for manufacturing micro capacitive ultrasonic transducer recited in claim 11, wherein the imprint method in the step c) can be chosen from the set of hot stamping, laser imprint, and nanoimprint.

16. The imprint method for manufacturing micro capacitive ultrasonic transducer recited in claim 11, wherein the formation of the plurality of upper electrodes in the step e) includes the following steps:

(1) forming a conductive layer on a polymer film, then coating a photoresist film on the conductive layer;

(2) using photolithography technology to form a photoresist mask arranged in order on the photoresist film; and (3) etching the conductive layer to form the plurality of upper electrode plates corresponding to the photoresist mask.

17. The imprint method for manufacturing micro capacitive ultrasonic transducer recited in claim 11, wherein the formation of the plurality of upper electrodes in the step e) includes the following steps:

(1') forming a conductive layer consisted of flexible material onto the polymer film; and (2') using an imprint method to form the plurality of upper electrodes within the conductive layer.

18. The imprint method for manufacturing micro capacitive ultrasonic transducer recited in claim 17, wherein the imprint method in the step (2') can be chosen from the set of hot stamping, laser imprinting, and nanoimprint.

19. The imprint method for manufacturing micro capacitive ultrasonic transducer recited in claim 11, wherein the material of the support film layer is a flexible polymer material.

20. The imprint method for manufacturing micro capacitive ultrasonic transducer recited in claim 11, wherein the material of the polymer film is the same as that of the support film layer, which is a flexible polymer material.

* * * * *